United States Patent [19]

Smith

[11] Patent Number: 4,949,977

[45] Date of Patent: Aug. 21, 1990

[54] GAME WITH TABLE TOP AND WALL SUPPORTED GAME BOARDS

[76] Inventor: Michael J. Smith, 426 Northwood Rd., North Bend, Oreg. 97459

[21] Appl. No.: 308,632

[22] Filed: Feb. 10, 1989

[51] Int. Cl.[5] ..... A63F 9/02

[52] U.S. Cl. ..... 273/261; 273/408; 273/409

[58] Field of Search ..... 273/261, 142 A, 142 D, 273/408, 409

[56] References Cited

U.S. PATENT DOCUMENTS

| | | | |
|---|---|---|---|
| 3,059,928 | 10/1962 | Flanagan | 273/408 |
| 3,559,993 | 2/1971 | Thomas | 273/278 X |
| 3,697,073 | 10/1972 | Dooley | 273/408 |
| 3,776,554 | 12/1973 | Capablanca et al. | 273/261 |
| 3,917,273 | 11/1975 | Blakewood | 273/261 |
| 3,979,117 | 9/1976 | Worsham | 273/408 |
| 4,019,740 | 4/1977 | Ball et al. | 273/261 |
| 4,314,703 | 2/1982 | Grottola | 273/408 |
| 4,553,736 | 11/1985 | Linnekin | 273/261 |
| 4,681,325 | 7/1987 | Sheem | 273/94 X |

FOREIGN PATENT DOCUMENTS

| | | | |
|---|---|---|---|
| 3610137 | 10/1987 | Fed. Rep. of Germany | 273/408 |
| 2034590 | 6/1980 | United Kingdom | 273/409 |
| 2127701 | 4/1984 | United Kingdom | 273/409 |

OTHER PUBLICATIONS

Sportcraft, "Pro League Revolving Dartboard Games", *The Sporting Goods Dealer,* Sep., 1971, p. 137.

*Primary Examiner*—William H. Grieb
*Assistant Examiner*—William E. Stoll
*Attorney, Agent, or Firm*—James D. Givnan, Jr.

[57] ABSTRACT

Game boards one each for table top and wall placement and having corresponding areas defined thereon. Each player or team of players has a set of game pieces. Moves of certain of the game pieces may be determined by the impact point of a player aimed component such as a dart. The game boards may display a modified game board design on their reverse sides.

6 Claims, 1 Drawing Sheet

4
23
24
4
H
8
2

1
3
D
8
D
L 7
17
5
2A
17
7

21

K
Q
B
R
N
B
R
N
P2
P2
P2
P2
P1
P1
P1
P1
18
8
1 or 2
20

GAME WITH TABLE TOP AND WALL SUPPORTED GAME BOARDS

BACKGROUND OF THE INVENTION

The present invention pertains generally to games played indoors and with sets of playing pieces.

In the prior art are games with multiple game boards, as for example, the game shown in U. S. Pat. No. 3,979,117 wherein all the boards are wall attached and constitute targets for darts. U. S. Pat. No. 3,697,073 discloses a wall attached panel on which fairway images are displayed with a dart landing site simulating golf ball location. U. S. Pat. No. 4,314,703 indicates the utilization of a dart board of a segmented nature with board areas associated with playing card indicia e.g., seven of diamonds; jack of hearts, etc.,

SUMMARY OF THE PRESENT INVENTION

The present invention is embodied in multiple game boards of like configuration for table top and wall installation with an aimed indicator member for targeting at the wall mounted game board to indicate a game piece move on the table top mounted game board.

The game boards have corresponding areas to permit a player to move certain of his game pieces to the area on which an aimed member, such as a dart, lands. The boards, in one embodiment may be provided with radially orientated lanes of different lengths with what are termed dead areas therebetween. Circular lanes are disposed about a center area. The radial and circular lanes each include a multitude of spaces common to both lanes. The game pieces may be in the manner of chessmen. Other game board configurations may be utilized, as for example, that of a checkerboard.

Important objectives of the present game include the combining of strategy with the manual skill of a player to test the player's ability in each capacity; the provision of a game with some degree of chance whereby a player may benefit to a degree from luck to compensate for lack of manual skill.

DETAILED DESCRIPTION OF THE PREFERRED EMBODIMENTS

Figures 1, 2, 3, 4:
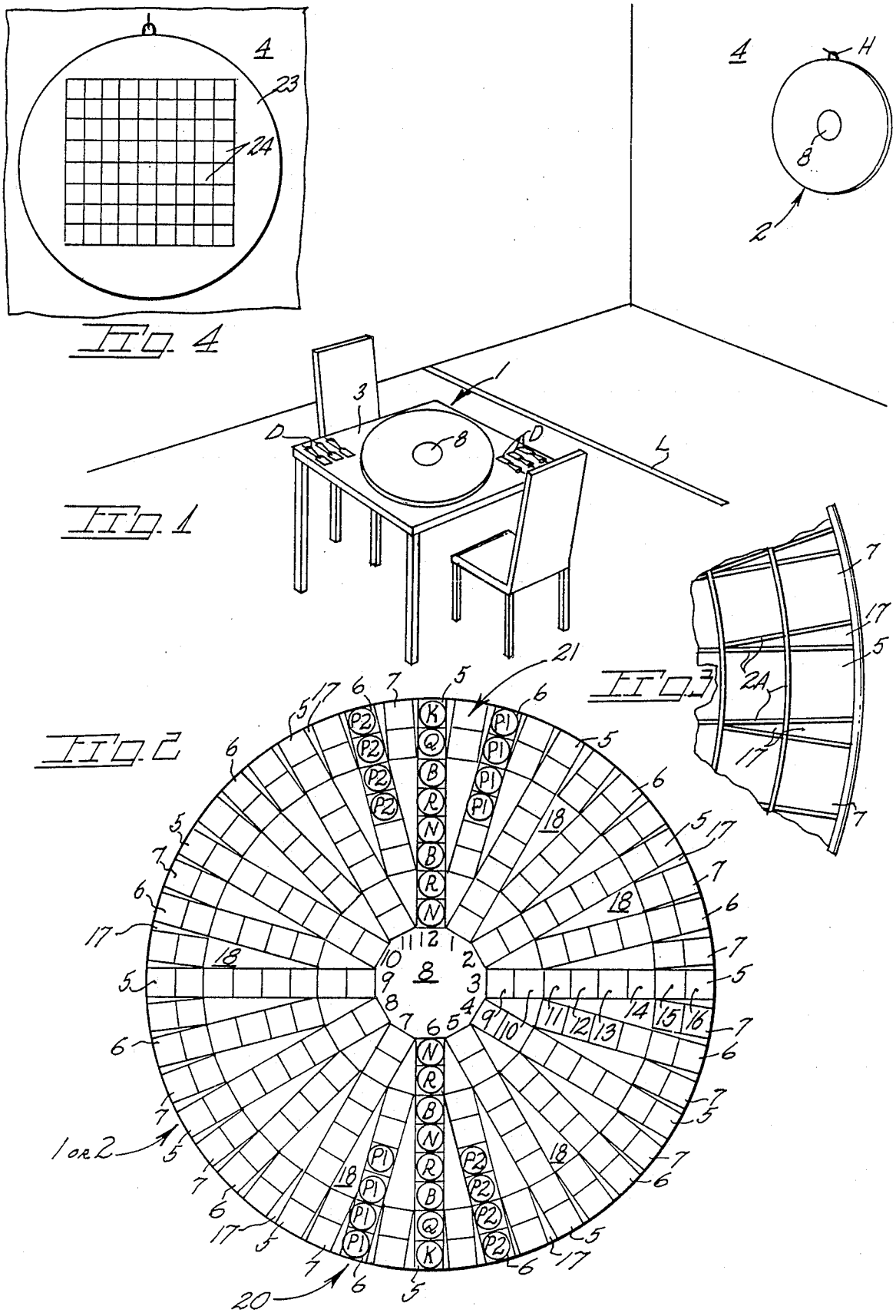
FIG. 1 is a perspective view of a room in which the present game is in place.
FIG. 2 is plan view of the game board utilized for table top and wall placement.
FIG. 3 is an enlarged fragmentary view of the wall mounted game board.
FIG. 4 is an elevational view of one of a pair of game boards with a modified playing surface.

With continuing attention to the drawings wherein applied reference numerals indicate parts similarly hereinafter identified, the reference numerals 1 and 2 indicate generally game boards of the present invention in place, respectively, on a table top 3 and a room wall 4. Hanger means H are in place on the rear side of board 2. Game board 2 would be constructed from a material not unlike that used in dart boards.

The game boards, as shown typically in FIG. 2, are substantially identical from the standpoint of their playing surfaces and include full radial lanes as at 5, partial radial lanes 6 and short radial lanes 7. Each of the lanes contains multiple spaces preferably denoted by color and in the case of wall mounted game board 2 additionally by grid-like wire members 2A. A center area at 8 contains circularly arranged numbers 1 through 12 each of which identifies a full radial lane 5.

Circular lanes comprised of the above noted spaces are indicated at 9 through 16. The multitude of spaces making up each circular lane are not necessarily contiguous and where non-contiguous define dead areas as at 17, and 18 which are shown as being of generally triangular shape.

Sets of game pieces generally at 20 and 21 (one set per player or team) have starting locations on table top game board 1 as shown in FIG. 2. In the preferred embodiment of the present game, the game pieces are analogous to the pieces of a chess set with the differences explained below. Player aimed means are indicated at D and may be darts.

A line at L on the room floor denotes a player's position during a dart throw.

The pawns P1 are located to the left side of a player's home lane (a full radial lane of a pair of aligned full radial lanes) and move radially one space at a time or circularly one space at a time. Their movement in a circular manner is limited to one direction i.e., clockwise about the board. The pawns may also move to a space designated by a player aimed means such a dart D. Pawns at P2 move in the same manner as described but are located to the right of the player's home lane and move counterclockwise along a circular lane. Both pawns P1 and P2 may also move one space at a time along the radial lanes.

Knights at N move either two spaces radially and one space circularly or vice versa. The knight game piece may jump over or move through spaces occupied by another game piece. A bishop at B may move circularly in either direction or along a radial lane one space at a time during a move. A rook at R moves radially in either direction or circularly as far as the next full radial lane and is limited to moving in one direction during a move. A queen at Q moves radially or circularly in any direction or a new space for the queen to occupy may be determined by a dart D. A king at K may move radially or circularly in any direction one space at a time. Further the king may make a combination move of one space circularly and one space radially or vice versa and in doing so may pass over or through an occupied space. The player aimed means is shown as being a dart which, at the player's option, is thrown at board 2 to determine a new space for either the queen or a pawn.

When utilizing a dart move, a player must place the piece he intends to move in center area 8 of the playing board. Upon completion of a successful dart throw (one which does not lead to immediate surrender of the piece), the player has the option of moving his piece to the space hit by the dart or to the outermost space of the corresponding radial lane on board 1. If the dart hits on a space containing either king and there is no other optional space available, the piece must be forfeited as if captured (except in a sudden death situation, to be explained later). The player's piece will be forfeited if the dart does not hit the dart board; bounces off the dart board; falls out of the dart board before it is determined where it hit; hits dead areas 17, 18 or 19 of the dart board; hits the center area 8 and is then exchanged for another piece as follows. Should the dart hit the center area 8 of the dart board, the player may exchange that piece for one of his pieces captured by the opponent. The rescued piece may be placed on any unoccupied space on the nearest circular lane to the center of the board. If there is no "safe move" (a move that does not lead to immediate capture) onto that circular lane, it may be placed on the next circular lane. These are the only two circular lanes a piece may enter on. If there is no "safe" move onto either circular lane, the piece must still be place on an unoccupied space of the nearest of the two circular lanes and risk any consequences. Should the dart hit a dead space, the only option is to move the piece to the outermost space of that radial lane. A piece is captured when an opponent's piece moves onto its space. A player may capture his own piece and must forfeit the captured piece. Kings may not be captured by a dart move.

When a player is down to two pieces, he enters what may be termed a sudden death situation. Once in a sudden death situation, the player's king is empowered with the ability to move utilizing a dart. Either piece is now subject to capture by a dart throw. All normal dart move rules apply, but kings are limited to moving offensively by dart only. Therefore, the following special rules apply to dart indicated moves by the king:

1. Player must announce he intends to move his king by dart indication, but the king remains in its present space and is not moved to the center of the board, as are pawns and queens.

2. A successful dart throw must end in the capture of an opponent's piece, at which time the king is moved to that space.

3. If a throw does not lead to the capture of an opponent's piece, the king remains on his space and is not forfeited, but the move is over and the opponent now takes his turn.

The game board shown in FIG. 4 may be typical of the reverse side 23 of the game boards above described. A checkerboard design at 24 is used in conjunction with a second checkerboard design imprinted on the unseen or reverse side of game board 1. In similarity to the moves of the pieces 20 and 21 the moves of certain checkers (not shown) on the table top located game board will be determined by the impact point of the aimed means on the wall mounted board.

While the drawing discloses the game board 1 set up for play by two players or teams, it is to be understood that three or four players or teams, each with a set of playing pieces, may play the game.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A game comprising, first and second game boards for table top and wall placement respectively, means on the game boards to denote radially disposed lanes of different lengths and circular lanes, said game boards having corresponding areas of like size and shape and position thereon, said lanes each comprised of spaces, sets of game pieces for individual movement one each by each player about said first game board, sets of player aimed means for identifying by contact one of said areas on said second game board, and said one of said areas identified by the player aimed means indicating the corresponding area on said first game board to which the last mentioned player may move one of said game pieces said second game board including grid-like pairs of wire members to denote said radially disposed lanes.

2. The game claimed in claim 1 wherein the game boards have a center area defined by one of said circular lanes.

3. The game claimed in claim 1 wherein some of said wire members intersect other of said wire members.

4. The game claimed in claim 1 wherein said first and second game boards each include a back side having checkerboard areas defined thereon.

5. The board claimed in claim 3 wherein the intersecting wire members denote game board areas of triangular shape located between said radially disposed lanes.

6. The game claimed in claim 1 wherein said pieces are chess men and said player aimed means are darts.

* * * * *